United States Patent [19]

Scherrer

[11] 3,968,743

[45] July 13, 1976

[54] REFUSE PACKER

[75] Inventor: John J. Scherrer, Elmira, Canada

[73] Assignee: B & L Metal Products (Elmira) Limited, Elmira, Canada

[22] Filed: May 19, 1975

[21] Appl. No.: 578,731

[30] Foreign Application Priority Data

May 22, 1974 United Kingdom ..... 22917/74

[52] U.S. Cl. ..... 100/52; 100/53; 100/256; 100/269 R

[51] Int. Cl.[2] ..... B30B 15/16

[58] Field of Search ..... 100/43, 48, 50, 52, 100/269 R

[56] References Cited

UNITED STATES PATENTS

| | | | |
|---|---|---|---|
| 2,253,617 | 8/1941 | Griffith | 100/52 |
| 3,643,589 | 2/1972 | Carter | 100/52 |
| 3,669,010 | 6/1972 | Lundgren | 100/52 |

*Primary Examiner*—Billy J. Wilhite
*Attorney, Agent, or Firm*—Sim & McBurney

[57] ABSTRACT

This invention provides a refuse packing apparatus including a frame defining a track along which a ram is adapted to reciprocate. A hydraulic cylinder urges the ram in either direction, and the rearward end of the hydraulic cylinder is connected to a lever member which in turn is spring-biased to an "at-rest" position. Under overload conditions, additional force is exerted by the hydraulic cylinder against the lever, and the latter is caused to pivot against the restoring tendency of the spring biasing means. Pivoting movement of the lever which exceeds a predetermined amount is caused to trigger a sensing component which is capable of reversing the direction of the ram by reversing the hydraulic cylinder.

6 Claims, 8 Drawing Figures

FIG. 1
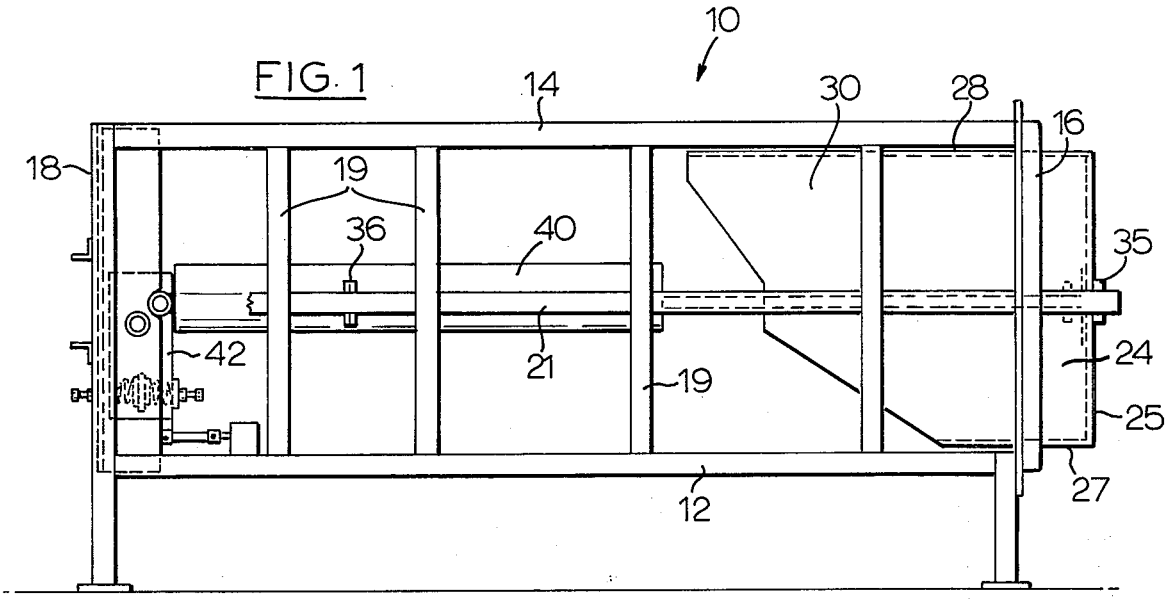
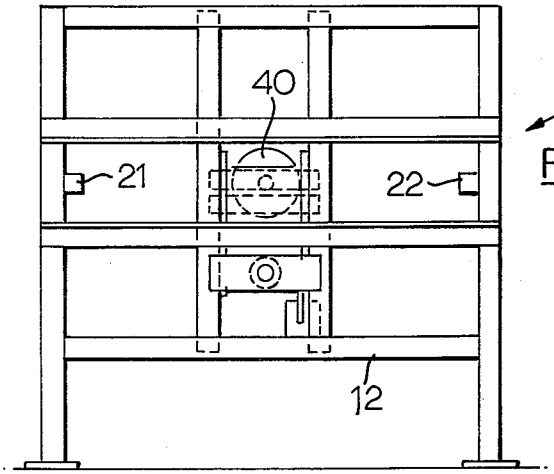
FIG. 2
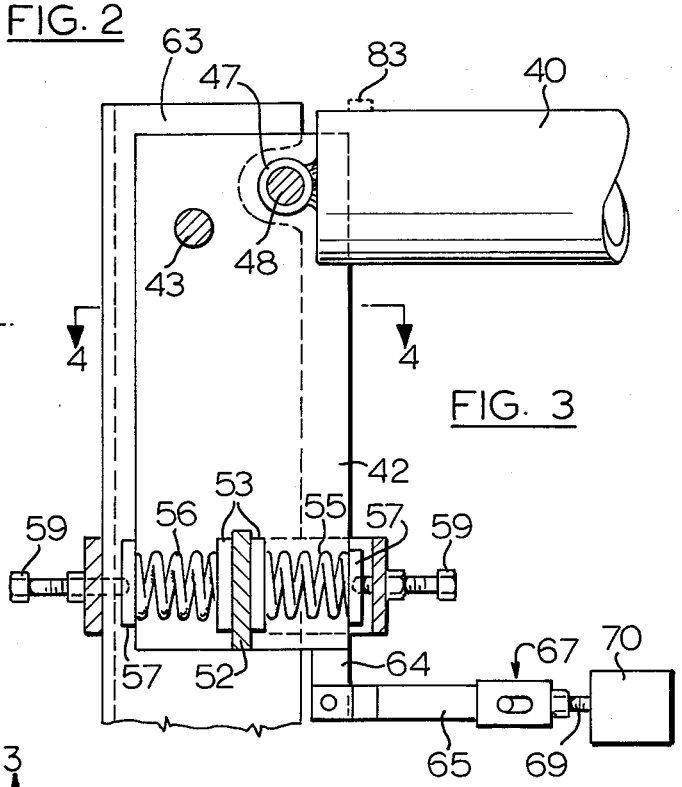
FIG. 3
FIG. 4
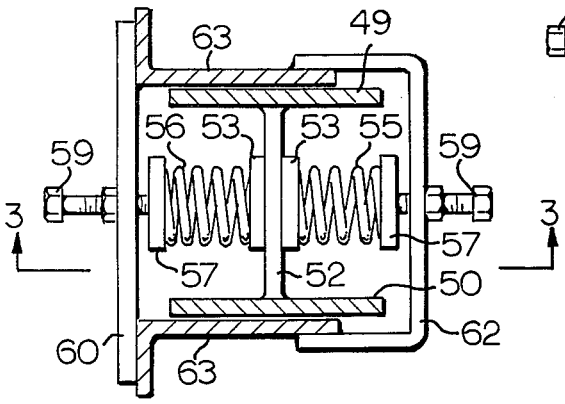

REFUSE PACKER

This invention relates generally to hydraulically operated, pressure-exerting systems, and has to do particularly with a refuse packer construction of the kind adapted to pack or push refuse, garbage, etc. in a given direction by applying repeated pressure strokes.

Conventional refuse packers usually include a hydraulically-driven ram which is adapted to reciprocate horizontally along guide tracks. The refuse packer is usually adapted to be attached to a larger container or truck, etc. having a square opening matching a similar opening in the packer. The hydraulically-driven ram reciprocates generally toward and away from the opening. Usually, a hopper or similar directive opening is provided in the top of the refuse packer construction immediately adjacent the opening which is intended to be in communication with the container opening. The hydraulically-driven ram is adapted to reciprocate substantially up to the opening through which the refuse, garbage, etc. is intended to be pushed or packed. This means that the ram would extend, on its forward thrust, past the hopper or upper opening through which refuse enters the packer.

In the operation of the conventional refuse packer equipment, the ram is withdrawn out of the way of the hopper, so that refuse may be dumped through the hopper opening into a location immediately forward of the ram. Then, the hydraulically-driven ram is urged toward the refuse in the direction of the opening through which the refuse is to be pushed.

It has been common in the conventional refuse packer to make use of limit-switches, micro-switches, etc. at the extremities of the stroke of the hydraulically-driven ram in order to trigger a change of direction.

Virtually all conventional refuse packers of the type discussed above require some sort of safety provision to allow for the situation arising when a large amount of tightlypacked refuse has already been urged into the larger container by the refuse packer, to such an extent that there is considerable resistance to any further packing of refuse into the container, which means a considerable resistance to forward motion of the ram against the refuse. In the conventional constructions, this safety measure is usually provided by utilizing an element capable of sensing the hydraulic pressure in the thrust cylinder, such that when the hydraulic pressure in the thrust cylinder climbs above a certain predetermined point, the element will bring about the reversal of the hydraulic thrust cylinder in order to withdraw the ram. Obviously, if the fluid pressure in the hydraulic thrust cylinder remains at all times below the pre-determined triggering pressure, reversal will not take place until the ram itself reaches the end of its travel and touches the limit-switch, micro-switch, or the like which is conventionally provided.

Some conventional refuse packer designs do not include any mechanism by which the ram is reversed upon the attainment of higher liquid pressures. These devices merely shut down when a pre-determined limit pressure is attained. On prior art devices of the latter kind, it is intended that reversal of the ram take place only when the limit position is attained.

In many of the prior art devices which utilize the elevated fluid pressure in the thrust cylinder to initiate ram reversal under overload conditions, the higher pressure is converted to an electronic signal, and the electronic signal is employed to shift the main directional valve controlling the direction of movement of the main thrust cylinder. This necessarily entails pressure lines, converters, electronic relays, solenoids, etc. and the latter involve a considerable expense.

Some prior art devices utilize the elevated pressure in the main thrust cylinder to shift the main directional valve directly, but this too involves additional components, such as pressure lines, pistons, connecting links, and so forth.

The above constructions tend to require considerable expense and are unnecessarily complicated for the job that they are intended to do. In view of the foregoing disadvantage, it is an aspect of this invention to provide an overload sensing and cylinder reversal system in which the number of necessary components is reduced, thus reducing the costs significantly also.

The construction herein described, in one embodiment, utilizes the actual force exerted between the end of the hydraulic thrust cylinder and the frame to which that end is attached, when the hydraulic thrust cylinder is in the overload condition. This force is caused to move a hydraulic component by being directly connected thereto, which hydraulic component directly controls the main directional valve.

In another embodiment, there is provided an overload sensing and hydraulic reversal system wherein the force mentioned in the above paragraph is used to operate a solenoid or other similar electronic component, which component directly operates the main directional valve of the main thrust cylinder.

Thus, an important distinction between the invention herein set forth and the constructions taught in the prior art is that the present invention utilizes the force exerted on the frame by the main thrust cylinder when in the overload condition, whereas the prior art devices utilize the pressure in the main thrust cylinder for the purpose of sensing an overload condition.

Accordingly, this invention provides, in combination: a frame which includes substantially rectilinear track means, a force-exerting member adapted to reciprocate along said track means, a lever member pivoted to said frame about a pivot point, a hydraulic component adapted positively to urge said force-exerting member along said track means, part of said hydraulic component being operatively connected to said force-exerting means, another part thereof being operatively connected to said lever member at a location such that activation of said hydraulic component applies torque to said lever member tending to rotate it about said pivot point with respect to said frame, resilient means biasing said lever member toward an at-rest position, and displacement-sensitive control means connected between said lever member and said frame, said control means being adapted, upon sensing a predetermined amount of displacement in said lever member, to reverse the direction of said hydraulic component.

Two embodiments of this invention are illustrated in the accompanying drawings, in which like numerals denote like parts throughout the several views, and in which:

FIG. 1 is an elevational view of a refuse packer constructed in accordance with the first embodiment of this invention;

FIG. 2 is an end view of the refuse packer of FIG. 1;

FIG. 3 is a vertical sectional view of one portion of the first embodiment of this invention, taken at the line 3—3 in FIG. 4;

FIG. 4 is a section looking downwardly at the line 4—4 in FIG. 3;

Figure 5:
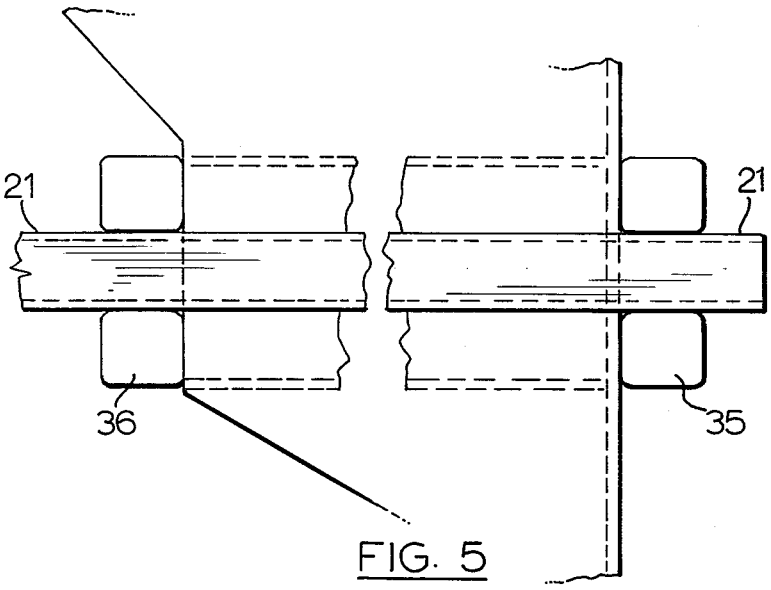
FIG. 5 is a partly broken away and partly collapsed elevational view of one of the components of the refuse packer of FIG. 1.

Referring first to FIG. 1, there is illustrated a refuse packer 10, which includes lower frame members 12, upper frame members 14, forward end frame members 16, and rear end frame members 18. Vertical supporting frame members 19 are also seen. A horizontal track is located about the middle of the refuse packer, and is defined by two rails 21, 22 (FIG. 2), which are supported inwardly of the members 19.

Mounted for horizontal reciprocation along the rails 21, 22 is a plunger 24 which includes a forward ram wall 25, a lower wall 27, an upper wall 28 and side walls 30 (only one visible in FIG. 1).

Figure 6:
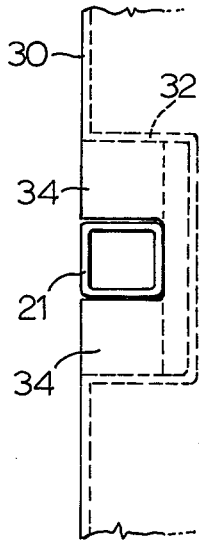
FIG. 6 is an end view of the components seen in FIG. 5.

Attention is directed to FIG. 6, which shows that each side wall 30 of the plunger 24 has a medial recess defined by a C-shaped member 32, which supports two slide-blocks 34 which are intended to contact the upper surface and bottom surface of the respective rail 21, 22.

A forward stop 35 and a rearward stop 36 are mounted in spaced-apart relation along each of the rails 21, 22. FIG. 5 shows how the appropriate portion of the plunger 24 comes into contact with the stops 35, 36. It is to be noted that the stops 35 and 36 are not micro-switches and do not themselves trigger any further hydraulic or electronic equipment directly.

Attention is now directed to FIGS. 1–4, for a description of the main thrust cylinder. The main thrust cylinder is shown by the numeral 40 in the Figures, and it will be seen that this cylinder is mounted at its rearward (leftward) end to a rocker panel 42, which is mounted for rocking motion in a vertical plane about a pivot pin 43, which latter is fixed with respect to upstanding members 63 of the frame of the refuse packer 10. More specifically, there is attached to the rearward end of the cylinder 40 a knuckle 47 through which a bar 48 snugly extends. The bar 48 constitutes the connection between the rearward end of the cylinder 40 and the rocker panel 42, and for this purpose the bar 48 passes through and is connected to suitable openings in the rocker panel 42.

It will be particularly noted in FIG. 4 that the rocker panel 42 consists of two spaced-apart plates 49, 50, and obviously the bar 48 extends between these two plates.

Bridging between the two plates 49, 50 at the lower end thereof is a web 52. The web 52 has means 53 on either side for the purpose of supporting one end of each of two coil springs 55, 56, the other ends of which are supported in the cup means 57. The means 57 are adjustable toward and away from each other, and are also supported in the position shown in FIGS. 3 and 4 by threaded members 59, which threadably engage brace members fixed with respect to the frame. The leftward threaded member 59 in FIG. 4 passes through a frame member proper 60, while the rightward threaded member 59 in FIG. 4 passes through a C-shaped member 62 which is welded to frame members 63.

It will be understood that the effect of the coil springs 55, 56 is to bias the rocker panel 42 toward a particular balanced or "at-rest" position, which we will assume is that illustrated in FIG. 3. When the rearward or leftward end of the main thrust cylinder 40 pushes leftwardly against the bar 48, this will cause the lower end of the rocker panel 42 to tend to move to the right, due to the fact that the direction of the force applied by the main thrust cylinder 40 on the rocker panel is displaced upwardly from the pivot pin 43. Thus, the rocker panel is a lever member acting on the lever principle.

By the same token, rightward force exerted by the main thrust cylinder 40 against the rocker panel 42 through the bar 48 will cause the lower end of the rocker panel 42 to tend to move to the left from the position shown in FIG. 3.

Also shown in FIG. 3 is a downwardly extending tab 64 to the lower end of which there is attached one end of a connecting link 65, the other end of the connecting link being attached at 67 to a triggering rod 69 of a hydraulic pilot valve 70.

In accordance with the first embodiment of this invention, the hydraulic pilot valve controls the main directional valve for the main thrust cylinder 40.

Figure 7:
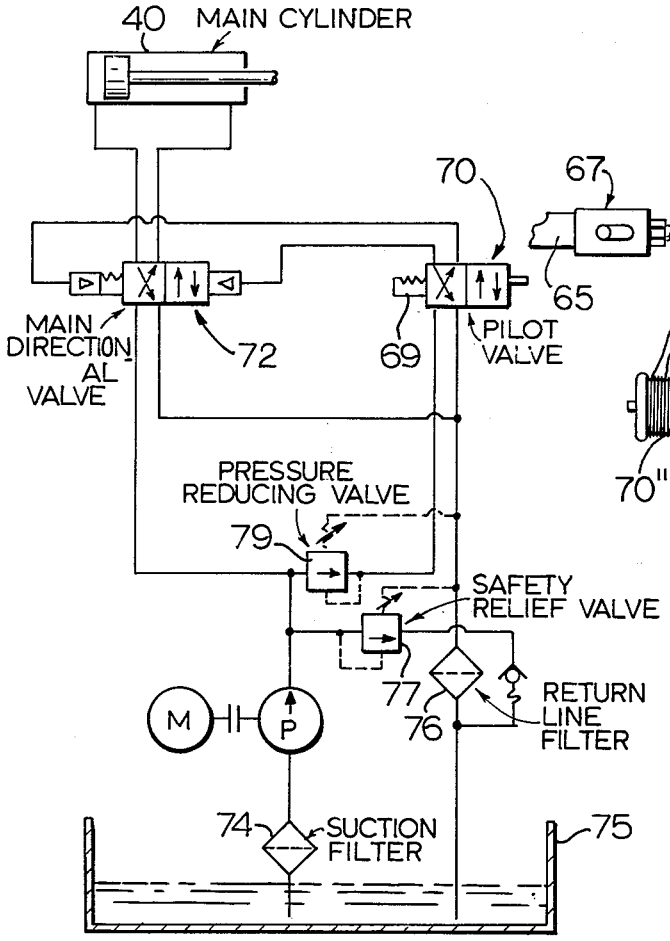
FIG. 7 is a hydraulic circuit representing the operation of the first embodiment of this invention.

The hydraulic circuit diagram of FIG. 7 shows a suitable hydraulic circuit which may be employed with the first embodiment of this invention. Specifically, in FIG. 7 the valve 70 is shown at the upper right, and directly controls the main directional valve 72 which operates the main thrust cylinder 40 of the refuse packer 10.

In FIG. 7 the pump has been labelled P, and the suction filter on the suction intake of the pump P is shown at 74. The motor is labelled M and the tank is identified with the numeral 75. A return line filter 76 is located in the return line, and a safety release valve 77 is also provided. A pressure reducing valve 79 is provided in the output line from the pump P, and the output from the pressure-reducing valve 79 is fed through the pilot valve 70 and operates the spindle of the main directional valve 72.

The operation of the first embodiment will now be clear. Whenever the plunger meets increase resistance either by virtue of abutting one of the stops 35, 36 or by virtue of its inability further to compress the refuse being packed, an additional force is applied by the leftward end of the main thrust cylinder 40 against the bar 48 and thus against the rocker panel 42, either in the leftward or rightward direction as seen in FIG. 3, and this force, if it is sufficient (thus representing an overload condition) will be enough to move the lower end of the rocker panel against the resistance of the respective coil spring 55, 56, to a sufficient degree to reverse the pilot valve 70.

It will be noted that the connection of the rightward end of the connecting link 65 with the control rod 69 of the pilot valve 70 is through an elongated slot which gives the connection a certain amount of "play". This "play" is desirable because it is obvious that minor amounts of resistance to the movement of the plunger 24 should not be permitted to reverse the plunger.

Figure 8:
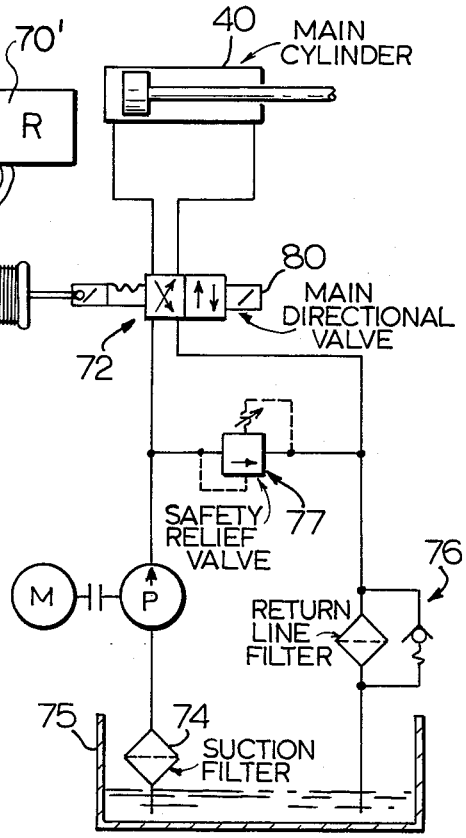
FIG. 8 is a hydraulic circuit representing the operation of the second embodiment of this invention.

FIG. 8 shows the hydraulic circuit which would be utilized for the second embodiment of this invention, in which the valve 70 is replaced by a switching relay 70′ marked R, which operates a solenoid shown at 70″, which operates directly on the spindle 80 of the main directional valve 72. The remaining components in FIG. 8 have been given the same numbers as in FIG. 7, for consistency.

In a variant applicable to the second embodiment of this invention, the forward and rearward stops 35 and 36 are dispensed with, and in which the hydraulic cylinder 40 is provided with conventional forward and rearward limit switches incorporated in the cylinder 40 itself. In FIG. 3, the position of the rearward limit switch connection has been shown in broken lines at 83 (even though FIG. 3 shows the first embodiment, to which this variant is not applicable). Thus, the cylinder 40 would be a selfreversing cylinder in this variant and reversal would automatically take place when the piston reaches either end of its travel.

The limit switches incorporated in the main hydraulic cylinder are electrical switches, and these would be utilized in conjunction with the hydraulic circuit shown in FIG. 8 and described previously. A forward limit switch on the cylinder would energize the solenoid 70'' to shift the spindle of the main directional valve to the position allowing rearward motion of the hydraulic piston, while the rearward limit switch on the hydraulic cylinder would operate the solenoid to shift the spindle of the main directional valve in the other direction, thus allowing forward movement of the piston of the hydraulic cylinder.

What I claim is:

1. In combination:

a frame which includes substantially rectilinear track means, a force-exerting member adapted to reciprocate along said track means, a lever member pivoted to said frame about a pivot point, a hydraulic component adapted positively to urge said force-exerting member along said track means, part of said hydraulic component being operatively connected to said force-exerting means, another part thereof being operatively connected to said lever member at a location such that activation of said hydraulic component applies torque to said lever member tending to rotate it about said pivot point with respect to said frame, resilient means biasing said lever member toward an at-rest position, and displacement-sensitive control means connected between said lever member and said frame, said control means being adapted, upon sensing a predetermined amount of displacement in said lever member, to reverse the direction of said hydraulic component.

2. The invention claimed in claim 1, in which said hydraulic component is a hydraulic cylinder and piston with means for admitting pressurized hydraulic fluid at either side of the piston in the cylinder.

3. The invention claimed in claim 2, in which said control means includes a pilot valve which controls a main directional valve directly determining to which side of the piston the pressurized hydraulic fluid shall be admitted.

4. The invention claimed in claim 2, in which said control means includes an electrical switch controlling a solenoid element which moves a main directional valve adapted to direct pressurized hydraulic fluid to one side or the other of said piston.

5. The invention claimed in claim 2, in which the force-exerting member is the ram of a refuse-packer, and in which said hydraulic cylinder incorporates reversing limit switches triggered by the piston at the ends of its travel, said limit switches controlling a main directional valve.

6. The invention claimed in claim 2, in which a rearward stop and a forward stop are fixedly secured to said track means behind and in front of said force-exerting member, whereby contact between the force-exerting member and either stop will cause said hydraulic component to apply a torque to said lever, and thereby cause said control means to reverse the direction of said hydraulic component.

* * * * *